US009887032B2

(12) United States Patent
Dong et al.

(10) Patent No.: US 9,887,032 B2
(45) Date of Patent: Feb. 6, 2018

(54) MAGNETIC COMPONENT AND TRANSFORMER

(71) Applicant: DELTA ELECTRONICS, INC., Taoyuan Hsien (CN)

(72) Inventors: Na Dong, Taoyuan Hsien (CN); Yicong Xie, Taoyuan Hsien (CN); Min Zhou, Taoyuan Hsien (CN)

(73) Assignee: DELTA ELECTRONICS, INC., Taoyuan, Taiwan (CN)

( * ) Notice: Subject to any disclaimer, the term of this patent is extended or adjusted under 35 U.S.C. 154(b) by 274 days.

(21) Appl. No.: 14/800,127

(22) Filed: Jul. 15, 2015

(65) Prior Publication Data

US 2016/0217900 A1 Jul. 28, 2016

(30) Foreign Application Priority Data

Jan. 23, 2015 (CN) ..... 2015 1 0035745

(51) Int. Cl.

| | |
|---|---|
| ***H01F 17/06*** | (2006.01) |
| ***H01F 27/24*** | (2006.01) |
| ***H01F 21/08*** | (2006.01) |
| ***H01F 27/02*** | (2006.01) |
| ***H01F 27/30*** | (2006.01) |
| ***H01F 27/28*** | (2006.01) |

(Continued)

(52) U.S. Cl.

CPC ..... *H01F 27/24* (2013.01); *H01F 3/14* (2013.01); *H01F 27/2823* (2013.01); *H01F 27/34* (2013.01); *H01F 2027/348* (2013.01)

(58) Field of Classification Search

USPC ..... 336/178, 134, 165, 212–215, 83, 192, 336/198

See application file for complete search history.

(56) References Cited

U.S. PATENT DOCUMENTS 2,947,961 A * 8/1960 Wahlgren ..... H01F 27/245 336/212
4,259,654 A * 3/1981 Persson ..... H01F 27/367 336/212

(Continued)

FOREIGN PATENT DOCUMENTS

CN 2446641 Y 9/2001
CN 1577647 A 2/2005

(Continued)

OTHER PUBLICATIONS

1st Office Action dated May 4, 2017 by the CN Office.
1st Office Action dated May 5, 2017 by the TW Office.

*Primary Examiner* — Elvin G Enad
*Assistant Examiner* — Kazi Hossain
(74) *Attorney, Agent, or Firm* — Yunling Ren

(57) ABSTRACT

A magnetic component and a transformer are provided by the present disclosure. The magnetic component includes: at least three core columns; and a winding wound around at least one of the at least three core columns; wherein a medium having a relative initial permeability equal to 1 is disposed on at least one side of the at least three core columns. In the present disclosure, a conventional magnetic cover board with a high relative initial permeability is replaced by a medium with a relative initial permeability (ur) satisfied ur=1, such as air or a cover board.

21 Claims, 11 Drawing Sheets

(51) Int. Cl.
*H01F 3/14* (2006.01)
*H01F 27/34* (2006.01)

(56) References Cited

U.S. PATENT DOCUMENTS

| | | | | | |
|---|---|---|---|---|---|
| 4,365,224 | A * | 12/1982 | Philberth | H01F 27/245 | 336/212 |
| 4,939,623 | A * | 7/1990 | Equi | H01F 27/027 | 336/107 |
| 6,087,922 | A * | 7/2000 | Smith | H01F 27/2847 | 336/200 |
| 7,701,317 | B2 * | 4/2010 | Sullivan | H01F 27/2847 | 29/602.1 |
| 2004/0080978 | A1 * | 4/2004 | Jitaru | G11C 11/15 | 365/173 |
| 2005/0012583 | A1 * | 1/2005 | Sutardja | H01F 3/10 | 336/178 |
| 2008/0012680 | A1 * | 1/2008 | Muelleman | F41B 6/006 | 336/212 |
| 2013/0088314 | A1 | 4/2013 | Francoeur et al. | | |
| 2014/0102202 | A1 * | 4/2014 | Shibata | G01N 29/043 | 73/596 |
| 2015/0069853 | A1 * | 3/2015 | Wang | H02M 1/14 | 307/104 |

FOREIGN PATENT DOCUMENTS

| | | | |
|---|---|---|---|
| RU | 2306212 | C2 | 9/2007 |
| TW | 201004084 | A | 1/2010 |
| TW | 201447939 | A | 12/2014 |
| TW | M491930 | U | 12/2014 |
| WO | 0225677 | A2 | 3/2002 |

* cited by examiner

MAGNETIC COMPONENT AND TRANSFORMER

CROSS-REFERENCE TO RELATED APPLICATIONS

This application is based on and claims priority from Chinese Patent Application No. 201510035745.6, filed Jan. 23, 2015, the entire contents of which are incorporated herein by reference.

TECHNICAL FIELD

The present disclosure relates to a magnetic component, and more particularly, to a magnetic component which may reduce an eddy current loss caused by an air gap.

BACKGROUND

In recent years, one of the important development trends of the switching power supplies is miniaturization. In a switching power supply, a magnetic component accounts for a large proportion in volume, weight, loss and cost, so design and optimization of the magnetic component is crucial. One effective means to reduce the volume of the magnetic component and to improve a power density is to increase a frequency of the switching power supply, which is a focus of the conventional magnetic design. In high-frequency magnetic design, the most widely-used winding is the PCB winding, because compared with a winding having a conventional winding structure, the PCB winding has huge advantages in terms of fabrication, cost, reproducibility and modularity. As far as a magnetic core is concerned, ferrite has a low loss and cost compared with other magnetic materials, so in the conventional design of transformers and inductors, ferrite is mostly used as the magnetic core. Since the ferrite has a high permeability, and in general, a relative permeability of the ferrite reaches up to hundreds or even thousands, in order to achieve a desired inductance of the magnetic component, an air gap may be cut in the magnetic core to bear the magnetic pressure drop and to store energy such that the magnetic component may not be saturated.

FIG. 1 is a sectional view of an EI magnetic core cut with an air gap seen from a direction parallel to a magnetic flux direction. In the drawing, dash lines represent a magnetic flux, arrows represent a magnetic flux direction which may vary with a current direction, and an air gap G is formed between an upper cover board and core columns 2. In a window W between the core columns 2 of the magnetic component, a magnetic field strength is relatively large in the vicinity of the air gap, and relatively small in the vicinity of the magnetic core. In addition, the magnetic flux may diffuse toward inside of the window W when the magnetic flux passes through the air gap, as shown by a magnetic induction line at point A in FIG. 1, which may affect the winding in the vicinity of the air gap G and increase a loss of the winding. Under a high-frequency eddy current effect, not only a skin effect and proximity effect loss of the winding coil may significantly increase, but also a large eddy current loss may be generated by the magnetic flux diffusing in the vicinity of the air gap.

In order to reduce the eddy current loss generated at the winding by the air gap, in the related art, leeds wire with a relative small diameter is adopted to form the winding for improving such condition. However, the winding formed of leeds wire has a low window filling rate, is time consuming in fabrication, and tends to be broken due to the small diameter.

In the related art, a magnetic core with a low permeability is adopted to avoid the air gap. However, the magnetic core with a low permeability, such as a magnetic powder core, has a loss that is far larger than that of the ferrite. Also, in the related art, a plurality of distributed air gaps may be cut on the ferrite magnetic core to reduce the effect of the air gap. However, this process is complex and time consuming. Moreover, the winding may be arranged at a position far away from the air gap, to make it far away from an area with a large magnetic field strength. However, this method obviously compromises the volume.

SUMMARY

Based on the above problems, a magnetic component is provided by the present disclosure, which may reduce the eddy current loss caused by the air gap without increasing the volume of the magnetic component, so as to reduce the loss of the magnetic component.

In order to achieve the above objective, a magnetic component is provided by the present disclosure, including: at least three core columns; and a winding, which is wound around at least one of the at least three core columns; wherein a medium having a relative initial permeability equal to 1 is disposed at at least one side of the at least three core columns.

A transformer is also provided by the present disclosure, including: a first core column; a second core column; and a winding, which is wound around the first core column and the second core column; wherein a medium having a relative initial permeability equal to 1 is disposed at at least one side of the first core column and the second core column.

An advantageous effect of the present disclosure over the related art lies in that, in the present disclosure, a magnetic cover board with a high relative initial permeability is replaced by the medium with a relative initial permeability (ur) satisfied ur=1, such as air or a cover board, in this way, compared with the conventional magnetic component, the magnetic core of the present disclosure is provided with the medium satisfied ur=1 on at least one side thereof, such that the magnetic flux diffusing at the air gap formed on this side conventionally may be distributed evenly, so as to significantly reduce the loss caused by the air gap, therefore, the winding loss only consists of the loss due to the skin effect and proximity effect. Moreover, the present disclosure does not increase the volume of the magnetic component, and even may reduce the volume of the magnetic component by eliminating the cover board, so as to increase the power density.

BRIEF DESCRIPTION OF THE DRAWINGS

FIG. 2 is a schematic diagram of a magnetic component according to a first embodiment of the present disclosure, showing distribution of a magnetic flux after being powered on.

DETAILED DESCRIPTION

Figure 1:
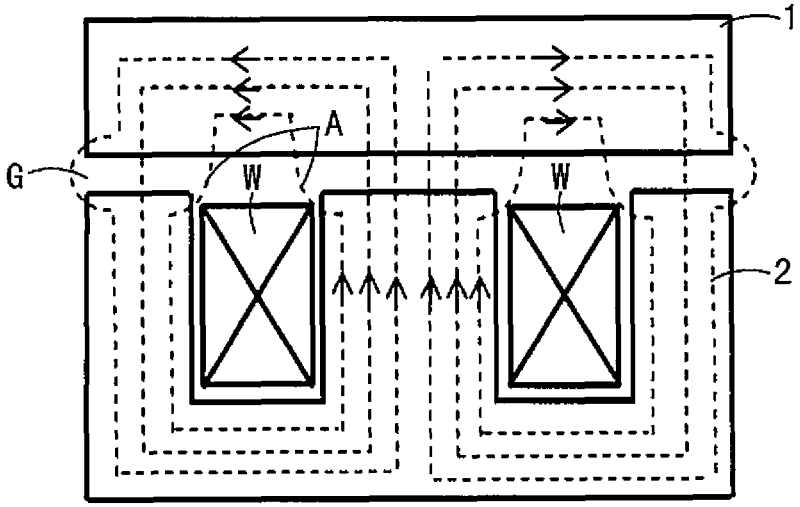
Fig. 1 (prior art)
FIG. 1 is a schematic diagram of a conventional magnetic component having an air gap.

Exemplary embodiments will now be described more comprehensively with reference to the accompanying drawings. However, the exemplary embodiments may be implemented in many forms, and should not be construed as being limited to the embodiments set forth herein. On the contrary, these embodiments are provided to make the present disclosure more thorough and complete, and fully convey the concept of the exemplary embodiments to those skilled in the art. In the drawings, thicknesses of areas and layers may be exaggerated for clarity. Same symbols represent the same or similar structures throughout the drawings, and thus the detailed description thereof may not be repeated.

In addition, features, structures or characteristics as described may be combined in one or more embodiments with any suitable manners. In the following description, many specific details are provided to enable a thorough understanding of the embodiments of the present disclosure. However, it should be appreciated by those skilled in the art that, the technical solutions of the present disclosure may be practiced without one or more of the particular details, and other methods, components, materials and the like may be adopted. In other cases, known structures, materials or operations are not illustrated or described in detail to avoid obscuring of the main technical idea of the present disclosure.

First Embodiment

Figure 2:
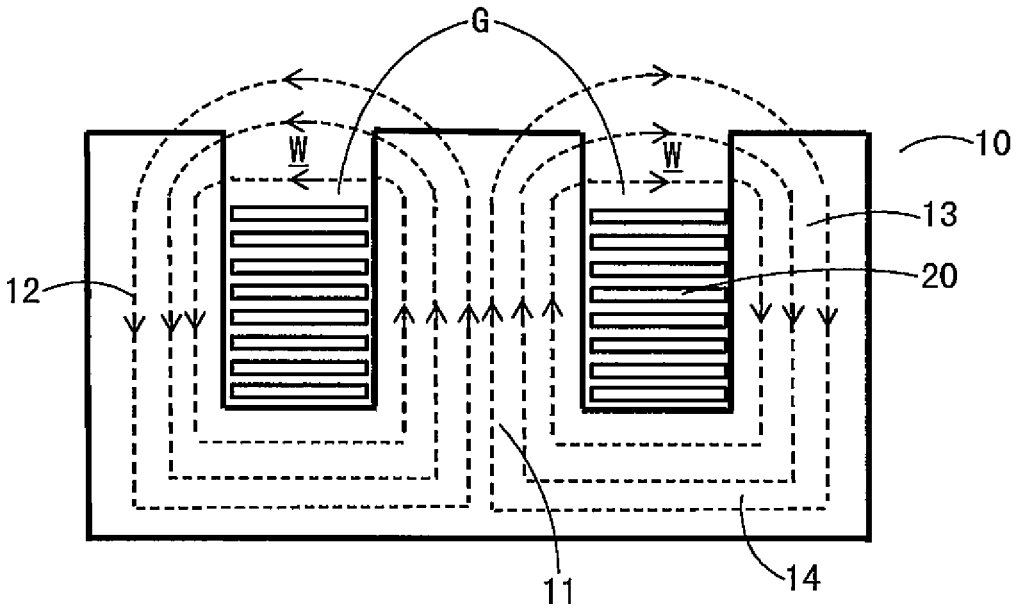
Figure 3A:
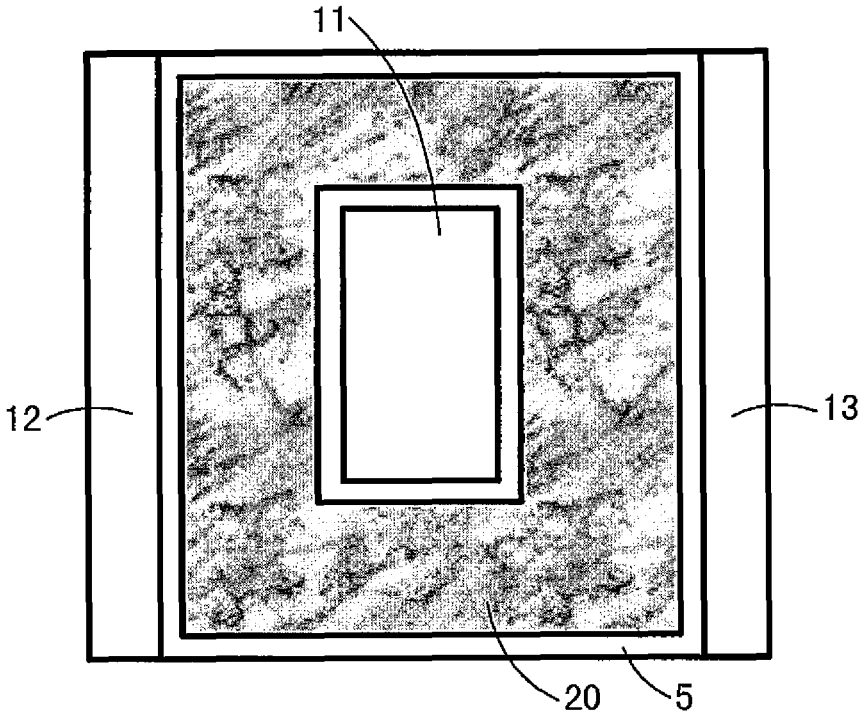
FIGS. 3*a* and 3*b* are plan views of two forms of the magnetic component according to the first embodiment of the present disclosure.
Figure 3B:
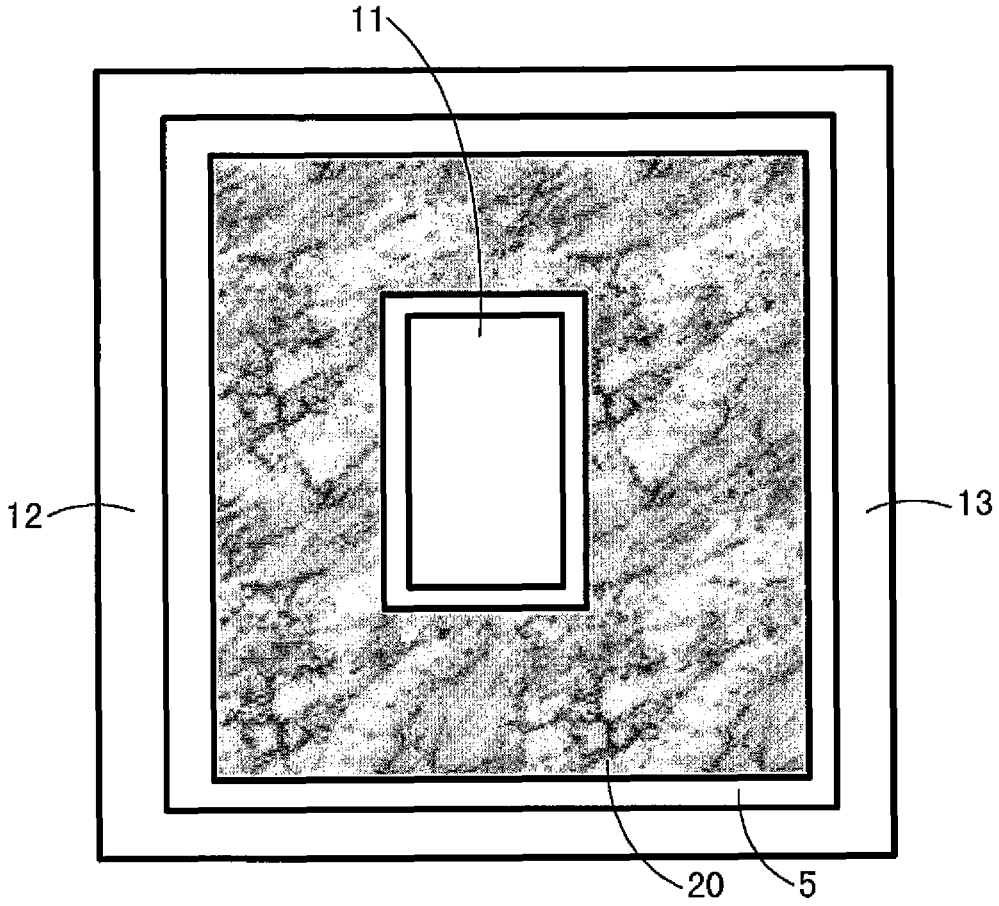

Referring to FIG. 2, a magnetic component is provided by the present embodiment, including a magnetic core 10 and a winding 20 wound around the magnetic core 10. The winding may be a planar structure, such as a PCB winding, a stamp-shaped copper sheet or a wiring disc. The magnetic core 10 may include a lower cover board 14 and three core columns disposed on the lower cover board 14, that is, a central core column 11 in the middle and a left core column 12 and a right core column 13 at both sides of the central core column 11. The magnetic core 10 may be formed of the same material or different materials. In the present embodiment, the magnetic core 10 is entirely made of a magnetic material with a relative initial permeability (ur) satisfied ur>1. The central core column 11, the left core column 12 and the right core column 13 may have the same height or different heights. Cross sections of individual core columns may be circular, rectangular, or racetrack-shaped, wherein the cross section of the core column is a plane taken along a direction perpendicular to the height of the core column. The magnetic core 10 may be an E-shaped magnetic core as shown in FIG. 3*a*, that is, the left core column 12 and the right core column 13 are separately two side pillars. Alternatively, the magnetic core 10 may be a pot-shaped magnetic core as shown in FIG. 3*b*, that is, the left core column 12 and the right core column 13 are connected as an integer, for example, by opening a notch in the magnetic core and leading an outgoing line of the winding to the outside of the magnetic core. The shape of the magnetic core is not limited to the above E-shaped, pot-shaped and U-shaped, and may also be PQ-shaped, PJ-shaped, RM-shaped and any other magnetic core shapes. The symbol 5 in FIGS. 3*a* and 3*b* denotes a space between the magnetic core 10 and the winding 20 remained due to tolerance or safety requirements.

In FIG. 2, the symbol G represents a portion in the magnetic component which bears the magnetic pressure, referred to as an air gap. The so-called air gap refers to, in a closed magnetic path, a distance for which the magnetic field strength passes through a medium with a relative initial permeability (ur) satisfied ur=1.

A medium satisfied ur=1 is provided at at least one side of the magnetic core 10. In the present embodiment, there is no cover body such as a cover board at an upper side of the magnetic core 10. That is to say, the upper side of the magnetic core 10 is exposed to outside air, and ur of the air is substantially equal to 1. The dash line in FIG. 2 shows a distribution of the magnetic flux in the magnetic core and the air gap. When a current direction changes, the magnetic flux direction may change accordingly. It may be seen that, in this embodiment, the magnetic field strength H over the air gap G is distributed evenly and smoothly near a copper sheet of the winding 20, and a direction thereof is substantially parallel to an upper surface of the copper sheet. Since the upper side of the magnetic core 10 is covered with the medium satisfied ur=1, there is nearly no magnetic field strength H in a direction perpendicular to a width of the copper sheet to cut the copper sheet. Therefore, a loss caused by the air gap on the winding may be significantly reduced. In addition, since the design is without a cover board, a magnetic core loss may be reduced accordingly, and only an eddy current loss caused by the skin effect and proximity effect is remained.

Therefore, compared with the conventional magnetic component having an upper cover board with a high relative initial permeability, the magnetic core without a cover board in the present embodiment is covered by a medium satisfied ur=1, allowing the magnetic flux diffusing at the air gap conventionally to be distributed evenly, so as to significantly reduce the loss caused by the air gap. Therefore, the winding loss only consists of the loss due to the skin effect and proximity effect. In addition, due to the design without a cover board, the magnetic core loss is reduced accordingly.

In addition, forms of the core column and the winding are not limited thereto. In another embodiment, more than three core columns may be provided, and the winding may be wound around one or more of the core columns.

Figure 4:
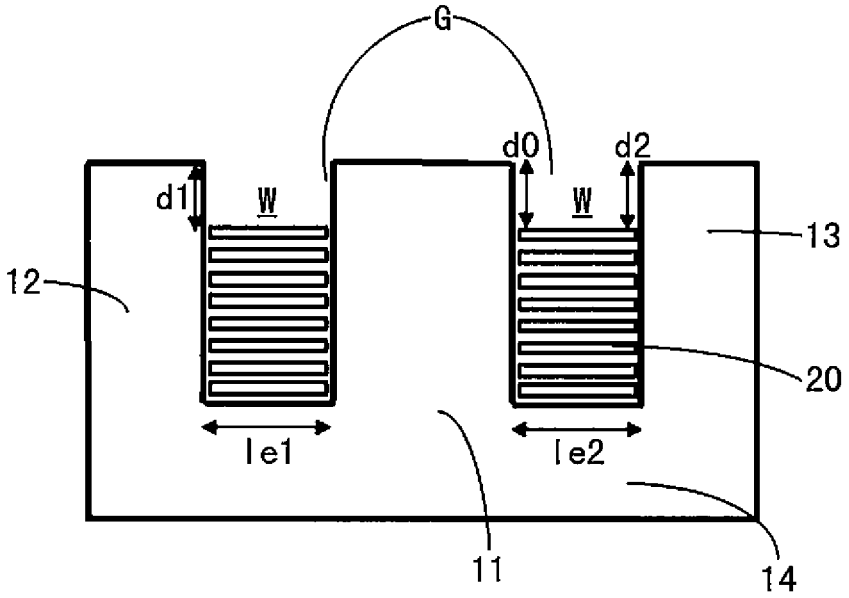
FIG. 4 is a schematic diagram of the magnetic component according to the first embodiment of the present disclosure, showing heights of core columns and widths of windows.

In an embodiment, the magnetic core structure may be further improved, to achieve a better loss reducing effect. Specifically, as shown in FIG. 4, a closest distance from an upper end of the central core column 11, i.e. one end of the central core column 11 that is close to the air, to an upper surface of the winding 20 is defined as d0, a closest distance from an upper end of the left core column 12 to the upper surface of the winding 20 is defined as d1, and a closest distance from an upper end of the right core column 13 to the upper surface of the winding 20 is defined as d2. If the left core column 12 and the right core column 13 constitute an integer as shown in FIG. 3*b*, a closest distance from an upper end of the integer to the upper surface of the winding 20 is defined as d1. A window W with a width is formed between two adjacent core columns, and the winding 20 is accommodated within the window W. In the present embodiment, there are two windows W, respectively with widths of le1 and le2. The minimum value among d0, d1 and d2 (or of d0 and d1) is denoted as d, i.e. d=min(d0,d1,d2) or d=min(d0, d1). Of the two widths of the windows, the maximum value is denoted as le, i.e. le=max(le1,le2). If the winding is too close to the central core column 11, the left core column 12, or the right core column 13, the magnetic field strength H diffusing in the air gap G will cut the winding, so as to generate a large eddy current loss. In the present embodiment, the above heights and widths satisfy the following condition: d>le/4. Under this condition, the magnetic field strength H diffusing in the air gap G will not cut the winding 20, and the magnetic field strength H near the winding 20 is distributed evenly and smoothly, and is in a direction almost parallel to the width direction of the copper sheet of the winding, therefore, there is nearly no loss caused by the air gap in the magnetic component.

In addition, the heights of the central core column 11, the left core column 12, and the right core column 13 may be adjusted, to change the amount of inductance of the transformer or the inductor. The central core column 11, the left core column 12, and the right core column 13 may have the same height, and their height may be adjusted together to achieve a desired amount of inductance. The central core column 11, the left core column 12, and the right core column 13 may also have different heights, and their heights may be adjusted separately, so as to easily and accurately adjust the amount of inductance. This manner for adjusting the amount of inductance is easier for operation, and is more capable of reducing the loss caused by the air gap compared with the conventional manner of cutting and inserting an air gap.

Second Embodiment

Figure 5:
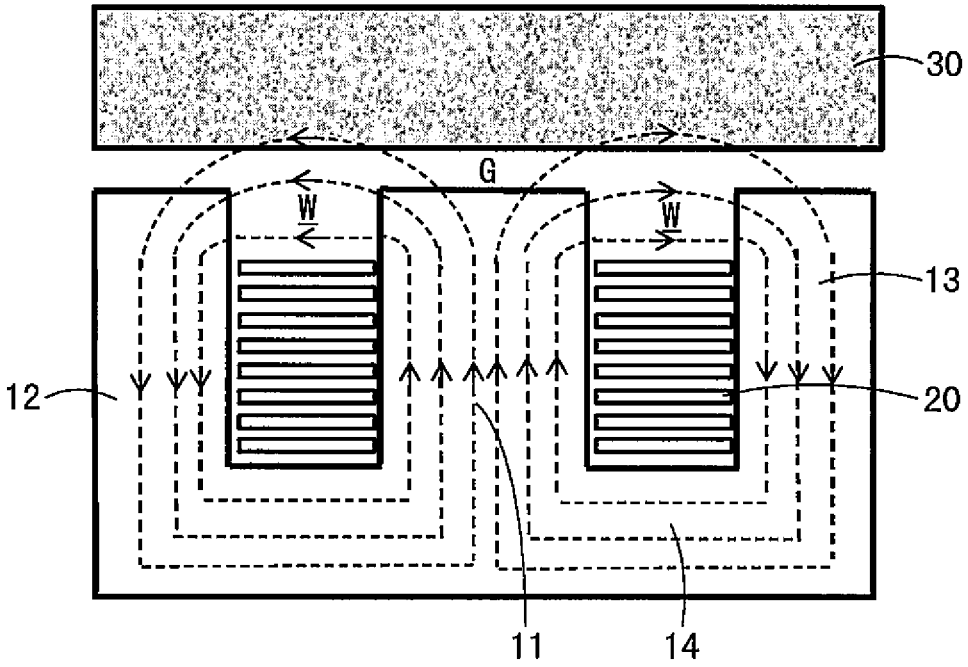
FIG. 5 is a schematic diagram of a magnetic component according to a second embodiment of the present disclosure.

Referring to FIG. 5, a difference between the magnetic component of the present embodiment and that of the first embodiment lies in that, the medium satisfied ur=1 is a cover board that may be made of an insulating material, such as a plastic, and a wood. In this embodiment, an upper cover board 30 satisfied ur=1 is provided to an upper side of the magnetic core 10 with an interval therebetween. For example, the upper cover board 30 may be fixed to the magnetic core 10 via an adhesive material or other materials as an interval therebetween. The upper cover board 30 may be disposed in parallel to the winding 20. Other parts of the magnetic component including the central core column 11, the left core column 12, the right core column 13 and the lower cover board 14 are made of the same or different magnetic materials satisfied ur>1.

As shown in the drawings, in the present embodiment, the magnetic field strength H at the air gap G is distributed evenly and smoothly near the copper sheet of the winding 20, and is in a direction almost parallel to the upper surface of the copper sheet. Since the upper side of the magnetic core 10 is covered with the upper cover board 30 satisfied ur=1, there is nearly no magnetic field strength H in a direction perpendicular to the width direction of the copper sheet to cut the copper sheet. Therefore, the loss caused by the air gap on the winding may be significantly reduced. In addition, the upper cover board 30 may also have a fixing function and the like.

Similarly, the height of the winding and the width of the window W between the core columns may also be designed to satisfy the condition mentioned in the first embodiment. Under this condition, the magnetic field strength H diffusing at the air gap G will not cut the winding 20, and the magnetic field strength H near the winding 20 is distributed evenly and smoothly, and is in a direction nearly parallel to the width direction of the copper sheet of the winding, so there is almost no loss caused by the air gap in the magnetic component.

Third Embodiment

Figure 6:
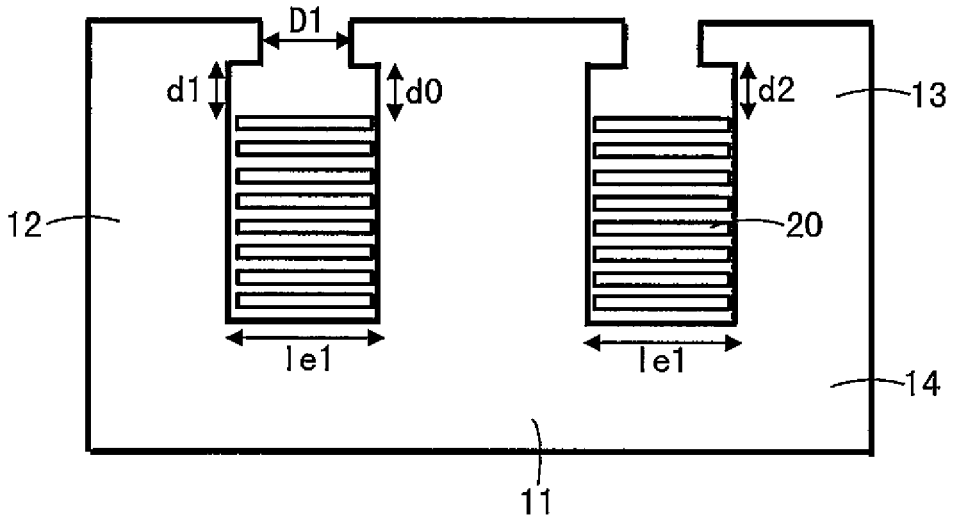
FIG. 6 is a schematic diagram of a magnetic component according to a third embodiment of the present disclosure.

Referring to FIG. 6, a difference between the magnetic component of the present embodiment and that of the first embodiment lies in that, the upper end of each of the core columns has a projection extending toward inside of the window W, such that a distance between the projections of adjacent core columns is relatively small. That is to say, distances from the central core column 11 to the left core column 12, and distances from the central core column 11 to the right core column 13 are not consistent, unlike the situation in the first and second embodiments that the distance is kept constant. A minimum distance between the projection of the central core column and the projection of the left core column is larger than 50% of the width of the window corresponding to the central core column and the left core column. Similarly, a minimum distance between the projection of the central core column and the projection of the right core column is larger than 50% of the width of the window corresponding to the central core column and the right core column. Taking the central core column and the left core column for example, the minimum distance between the projection of the central core column 11 and the projection of the left core column 12 is D1, and the width of the window corresponding to the central core column 11 and the left core column 12 is le1. The distance and the width satisfy the following condition: D1/le1>50%. And the condition of the height of the magnetic core and the width of the window in the first and second embodiments is also satisfied: d"=min(d0,d1,d2)>le=max(le1,le2)/4, wherein d0 is a distance from a lower surface of the projection of the central core column to the upper surface of the winding 20, d1 is a distance from a lower surface of the projection of the left core column 12 to the upper surface of the winding 20, and d2 is a distance from a lower surface of the projection of the right core column 13 to the upper surface of the winding 20. In this case, the minimum distance between the projection of the central core column 11 and the projection of the left core column 12 is D1, that is, a length of the air gap occupies a large part of the width le1 of the window, therefore, the magnetic field strength H is relatively smooth in a length direction of the air gap. Since the magnetic field strength H is almost parallel to the width direction of the copper sheet of the winding, the eddy current loss caused by the air gap of the winding can be avoided.

It should be noted that, the central, left and right core columns may project toward inside of the window in any form. For example, a cross section of the projection is trapezoidal, rectangular or other irregular shapes.

In the present embodiment, since the right core column 13 and the left core column 12 are symmetrical with respect to the central core column 11, the description of the right core column 13 is omitted. In another embodiment, a distance from the central core column 11 to the left core column 12 is different from a distance from the central core column 11 to the right core column 13, in this case, the left core column 12 and the right core column 13 may be designed separately according to the above numeral relationships, to avoid the eddy current loss caused by the air gap.

Fourth Embodiment

Figure 7:
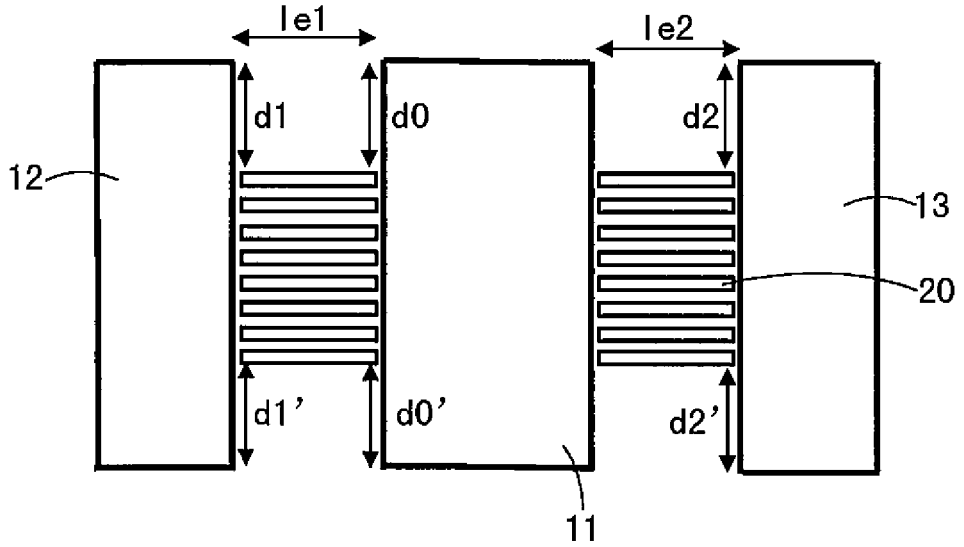
FIG. 7 is a schematic diagram of a magnetic component according to a fourth embodiment of the present disclosure.

Referring to FIG. 7, a difference between the magnetic component of the present embodiment and that of the first embodiment lies in that, the magnetic core 10 includes three core columns disposed separately, i.e. the central core column 1, the left core column 12 and the right core column 13, which are made of the same or different magnetic material satisfied ur>1. A medium satisfied ur=1 is provided on an upper side and a lower side of the magnetic core 10, and in the present embodiment, the medium is air. Although the distribution of the magnetic flux is not shown in FIG. 7, actually, the magnetic field strength H at the air gap G is distributed evenly and smoothly near the copper sheet of the winding 20, and is in a direction substantially parallel to the upper surface of the copper sheet. Since both the upper side and the lower side of the magnetic core 10 are covered with the medium satisfied ur=1, there is nearly no magnetic field strength H in a direction perpendicular to a width of the copper sheet to cut the copper sheet. Therefore, a loss caused by the air gap over the winding may be significantly reduced.

In the present embodiment, since neither of the upper side and the lower side of the magnetic core 10 is provided with a cover board, that is, an air gap exists at both of the upper side and the lower side of the magnetic core 10, the amount of inductance is relatively low, and the frequency is relatively high.

As shown in FIG. 7, distances from the upper surface of the winding 20 to upper ends of the core columns are respectively d0, d1 and d2, and distances from the lower surface of the winding 20 to lower ends of the core columns are respectively d0', d1' and d2'. Similarly, the condition for the height of the magnetic core and the width of the window in the first embodiment is satisfied: d=min(d0,d1,d2) >le=max(le1,le2)/4, and, d'=min(d0',d1',d2')>le=max(le1, le2)/4. Under this condition, the magnetic field strength H diffusing in the air gap G will not cut the winding 20, and the magnetic field strength H near the winding 20 is distributed evenly and smoothly, and is in a direction nearly parallel to the width direction of the copper sheet of the winding, so there is almost no loss caused by the air gap in the magnetic component.

Fifth Embodiment

Figure 8:
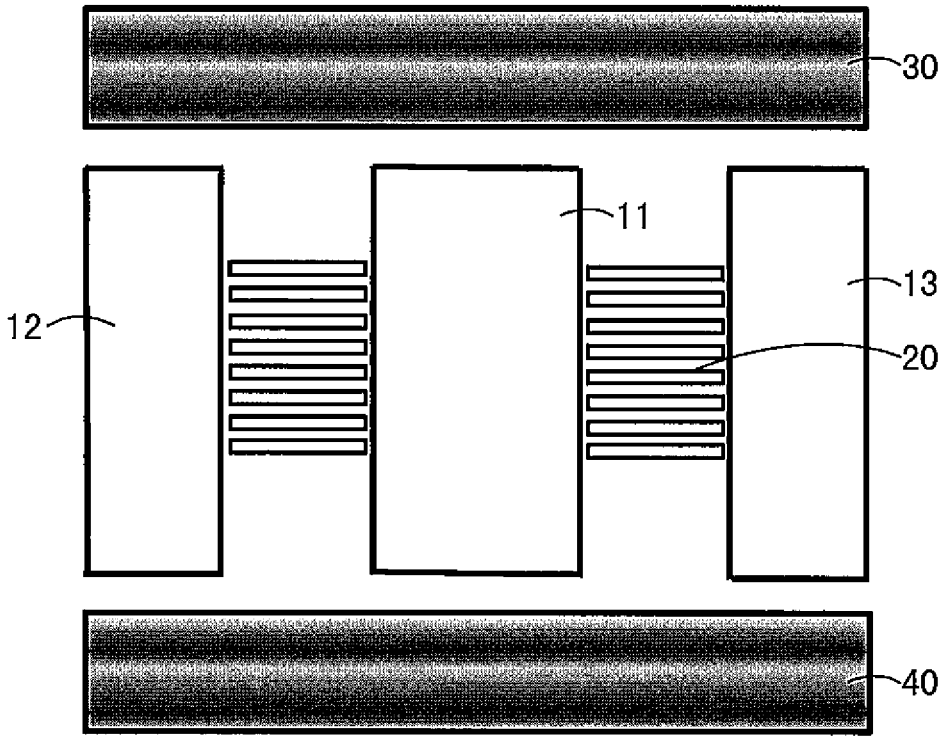
FIG. 8 is a schematic diagram of a magnetic component according to a fifth embodiment of the present disclosure.

Referring to FIG. 8, a difference between the magnetic component of the present embodiment and that of the fourth embodiment lies in that, the upper side and the lower side of the magnetic core 10 are respectively provided with an upper cover board 30 and a lower cover board 40 satisfied ur=1, and an air gap G is formed between the upper cover board 30, the lower cover board 40 and the magnetic core 10. Although the distribution of the magnetic flux is not shown in FIG. 8, actually, the magnetic field strength H at the air gap G is distributed evenly and smoothly near the copper sheet of the winding 20, and is in a direction substantially parallel to the upper surface of the copper sheet. Since both the upper side and the lower side of the magnetic core 10 are covered with the medium satisfied ur=1, there is nearly no magnetic field strength H in a direction perpendicular to a width of the copper sheet to cut the copper sheet. Therefore, a loss caused by the air gap over the winding may be significantly reduced. In addition, the upper cover board may also have a fixing function and the like.

Similarly, the height of the magnetic core and the width of the window may be designed to satisfy the condition in the fourth embodiment. Under this condition, the magnetic field strength H diffusing in the air gap G will not cut the winding 20, and the magnetic field strength H near the winding 20 is distributed evenly and smoothly, and is in a direction nearly parallel to the width direction of the copper sheet of the winding, so there is almost no loss caused by the air gap in the magnetic component.

Sixth Embodiment

Figure 9:
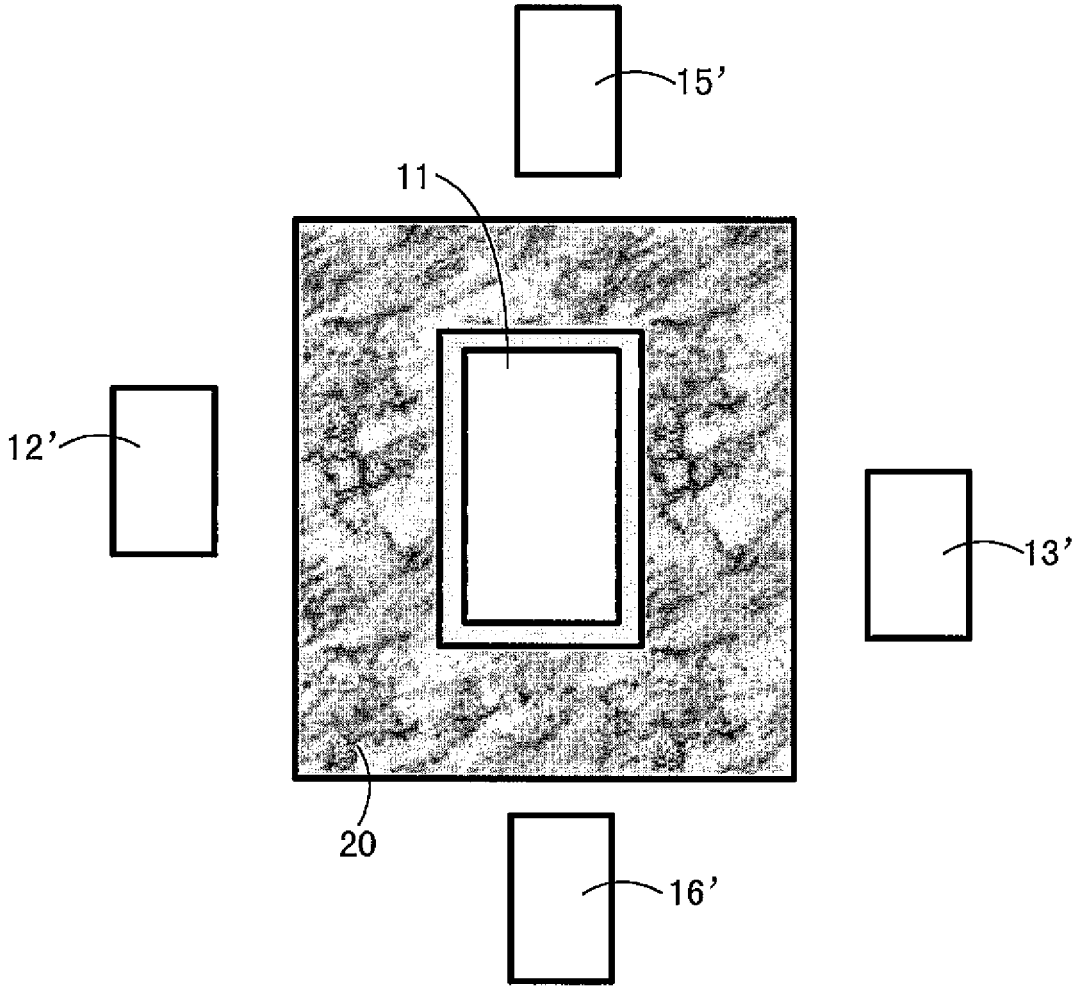
FIG. 9 is a plan view of a magnetic component according to a sixth embodiment of the present disclosure.

Referring to the plane view of the magnetic component shown in FIG. 9, a difference between the magnetic component of the present embodiment and that of the first embodiment lies in that, the central core column 11 is wound with the winding 20, and a plurality of side core columns are provided around the central core column 11, that is, in addition to a left side core column 12' and a right side core column 13', an upper side core column 15' and a lower side core column 16' and so on are provided. In the present embodiment, the side core columns are provided separately. In another embodiment, the side core columns may be connected to each other, and the winding may be wound around the central core column and at least one side core column. In the present embodiment, all the core columns are made of magnetic material satisfied ur>1.

The present embodiment may be combined with any one of the forms in the first to fifth embodiments. For example, the magnetic core may be provided with the upper cover board or the lower cover board made of magnetic material satisfied ur>1. Or, the upper side and/or the lower side of the magnetic core may be provided with a medium satisfied ur=1, and the medium is air or a cover board.

In addition, when the size of the magnetic core and the width of the window also satisfy the requirement similar to that in the first embodiment, that is, a minimum value among the distances from the upper surface of the winding to the ends of the core columns which are close to the medium satisfied ur=1, is greater than ¼ of the width of the window with the largest width among all the windows (the windows are formed between two adjacent core columns), then the effect of the loss caused by the air gap may be eliminated.

Seventh Embodiment

Figure 10:
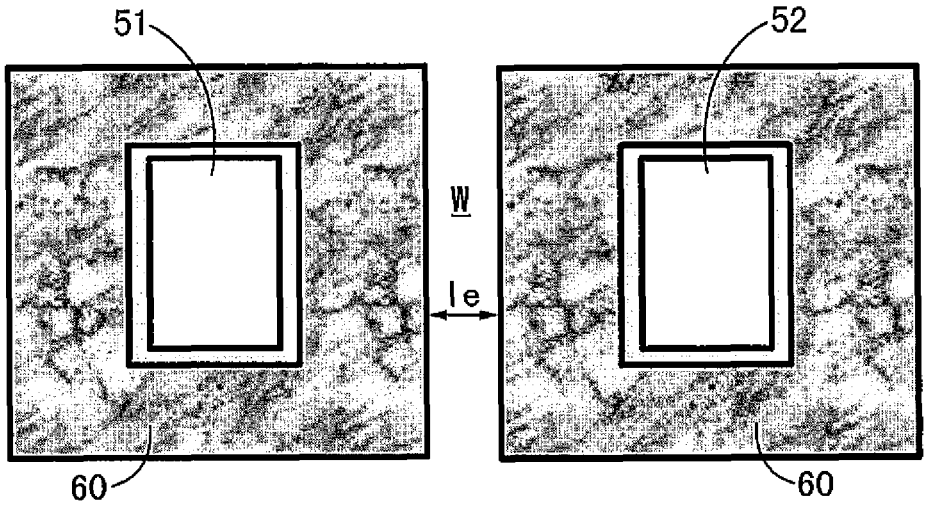
FIG. 10 is a plan view of a magnetic component according to a seventh embodiment of the present disclosure.

Referring to the plane view of the magnetic component shown in FIG. 10, the magnetic component of the present embodiment is a transformer, which includes a first core column 51, a second core column 52 and a winding 60 wound around the first core column 51 and the second core column 52. Both the first core column 51 and the second core column 52 are made of magnetic material satisfied ur>1, wherein, at least one side of the first core column 51 and the second core column 52 is provided with a medium having a relative initial permeability equal to 1.

The present embodiment may be combined with any one of the forms in the first to fifth embodiments. For example, the first core column 51 and the second core column 52 may be provided with the upper cover board or the lower cover board made of magnetic material satisfied ur>1. Or, the upper side and/or the lower side of the first core column 51 and the second core column 52 may be provided with a medium satisfied ur=1, and the medium is air or a cover board.

In addition, the width le of the window W is defined as a distance between two adjacent windings 60. When the size of the magnetic core and the width of the window also satisfy the requirement similar to that in the first embodiment, the effect of the loss caused by the air gap may be eliminated.

Accordingly, in the present disclosure, a conventional magnetic cover board with a high relative initial permeability is replaced by a medium with a relative initial permeability (ur) satisfied ur=1, such as air or a cover board, in this way, compared with the conventional magnetic components, at least one side of the magnetic core of the present disclosure is provided with the medium satisfied ur=1, such that the magnetic flux diffusing at the air gap formed on this side otherwise may be distributed evenly, so as to significantly reduce the loss caused by the air gap, therefore, the winding loss only consists of the loss due to the skin effect and proximity effect. Moreover, the present disclosure may not increase the volume of the magnetic component, and may even reduce the volume of the magnetic component by eliminating the cover board, so as to increase the power density.

Although the present disclosure has been described with reference to illustrative embodiments, it should be understood that, terms used herein are merely illustrative, exemplary and non-limiting. Since the present disclosure may be embodied in many manners without departing from the spirit or essence of the present disclosure, it should be understood that, the above embodiments are not limited to any details mentioned above, but should be interpreted in a broad sense within the spirit and scope defined by the appended claims. Therefore, all the alterations and modifications falling in the scope of the claims and its equivalent should be covered by the appended claims.

What is claimed is:

1. A magnetic component, comprising:

at least three core columns; and a winding wound around one of the core columns;

wherein a medium having a relative initial permeability equal to 1 is disposed on at least an upper side of the core columns, a window having a width is formed between two adjacent core columns, the winding is accommodated in the window, a width of one of the windows which has a maximum width is 1e, and a minimum distance from an uppermost end of each of the core columns to an uppermost surface of the winding is d, wherein d>1e/4.

2. The magnetic component according to claim 1, wherein the medium is air, which is disposed on the upper side of the core columns.

3. The magnetic component according to claim 1, wherein the medium having the relative initial permeability equal to 1 is a cover board, which is disposed on the upper side of the core columns with an interval therebetween.

4. The magnetic component according to claim 1, wherein the medium is disposed at the upper side of the core columns.

5. The magnetic component according to claim 4, further comprising a magnetic cover board, and a lower side of the core columns is disposed on the magnetic cover board.

6. The magnetic component according to claim 1, wherein the medium is disposed at both the upper side and a lower side of the core columns.

7. The magnetic component according to claim 6, wherein a minimum distance from a lower end of each of the core columns to a lower surface of the winding is d', wherein d'>1e/4.

8. The magnetic component according to claim 4, wherein the upper end of each of the core columns has a projection extending toward inside of the window, and a minimum distance between the projections of two adjacent core columns is more than 50% of the width of the window corresponding to the two core columns.

9. The magnetic component according to claim 8, wherein a minimum distance from a lower surface of each of the projections of the core columns to the upper surface of the winding is d", wherein d">1e/4.

10. The magnetic component according to claim 1, wherein a cross section of the core columns is circular, rectangular, or racetrack-shaped.

11. The magnetic component according to claim 1, wherein the winding is a planar winding.

12. The magnetic component according to claim 11, wherein the planar winding comprises a PCB winding, a stamp-shaped copper sheet or a wiring disc.

13. The magnetic component according to claim 1, wherein the core columns comprise a central core column and a plurality of side core columns disposed around the central core column.

14. The magnetic component according to claim 13, wherein the side core columns are connected to each other.

15. The magnetic component according to claim 13, wherein the winding is wound around the central core column, or, wherein the winding is wound around the central core column and at least one of the side core columns.

16. The magnetic component according to claim 1, wherein the core columns have the same height, or, wherein at least two of the core columns have different heights.

17. The magnetic component according to claim 13, wherein the side core columns are disposed symmetrically around the central core column.

18. A transformer, comprising:

a first core column;

a second core column; and a winding wound around the first core column and the second core column;

wherein a medium having a relative initial permeability equal to 1 is disposed on at least an upper side of the first core column and the second core column, a window is formed between the first core column and the second core column, a width of the window is 1e, and a minimum distance of a distance from an uppermost end of the first core column to an uppermost surface of the winding and a distance from an uppermost end of the second core column to the uppermost surface of the winding is d, wherein d>1e/4.

19. The transformer according to claim 18, further comprising a magnetic cover board, wherein a lower side of the first core column and the second core column is disposed on the magnetic cover board, and the medium is disposed at the upper side of the first core column and the second core column.

20. The magnetic component according to claim 6, wherein the medium is air.

21. The magnetic component according to claim 6, wherein the medium having the relative initial permeability equal to 1 is two cover boards, one of which is disposed on the upper side of the core columns with an interval therebetween, and the other one of which is disposed on the lower side of the core columns with the interval therebetween.

* * * * *